United States Patent [19]

Nelson

[11] 4,329,867

[45] May 18, 1982

[54] ARTICULATING FRAME PRESS

[76] Inventor: Richard E. Nelson, 53 E. Tacoma, Clawson, Mich. 48017

[21] Appl. No.: 156,642

[22] Filed: Jun. 5, 1980

[51] Int. Cl.[3] ..... B21J 13/04

[52] U.S. Cl. ..... 72/455; 72/446; 100/214; 100/229 R

[58] Field of Search ..... 72/446, 447, 455, 470; 100/229 R, 226, 214, 918

[56] References Cited

U.S. PATENT DOCUMENTS

| | | | |
|---|---|---|---|
| 1,579,480 | 4/1926 | Hoover | 100/229 R |
| 2,182,884 | 12/1939 | Stillman | 100/229 R |
| 2,558,140 | 6/1951 | Kruzik | 72/42 |
| 2,680,881 | 6/1954 | Mock | 100/229 R |
| 2,765,019 | 10/1956 | Evans | 72/455 |
| 2,812,543 | 11/1957 | Stacy | 100/229 R |
| 3,154,009 | 10/1964 | Dewyer | 100/214 |
| 3,418,922 | 12/1968 | Kip | 100/264 |
| 3,418,923 | 12/1968 | Zeitlin | 72/455 |
| 3,422,750 | 1/1969 | Anderson | 72/455 |
| 3,641,929 | 2/1972 | Ballard | 72/440 |
| 3,650,411 | 3/1972 | Reis | 100/918 |
| 3,651,754 | 3/1972 | Forest | 100/91 |
| 3,942,430 | 3/1976 | Day | 100/52 |

FOREIGN PATENT DOCUMENTS

| | | | |
|---|---|---|---|
| 664980 | 10/1950 | United Kingdom | 100/214 |

*Primary Examiner*—Gene Crosby

*Attorney, Agent, or Firm*—Basile, Weintraub & Hanlon

[57] ABSTRACT

A press for forming complementary parts including mold parts and metal stampings having an articulating frame is disclosed. The press of the present invention comprises a first bolster plate and a second bolster plate which in a first position are spaced apart in a parallel opposed manner. The frame may be articulated from the first position to a second position wherein the bolster plates are in a non parallel, non opposed arrangement. The frame comprises a first pair of spaced apart frame supports pivotally connected at their ends to the first and second bolster plates, and a second pair of spaced apart frame supports having a length less than the first pair of frame supports pivotally connected at their ends to the first and second bolster plates in a spaced apart manner. The pairs of spaced apart frame supports having unequal length, and the bolster plate to which the frames supports are pivoted form a four bar linkage mechanism which allows the bolsters to rotate relative to one another as the frame supports are articulated. A fixed platen and a movable platen are associated with the spaced apart bolster plates with the parts of a separable mold or die affixed to the platen in a complementary manner when the frame is in the first position. Swinging the press frame to the second position allows the lower half of the separated mold or die to be assembled to the platen without an overhead obstruction. In the second position the upper platen is also accessible from overhead without obstruction.

11 Claims, 10 Drawing Figures

ARTICULATING FRAME PRESS

BACKGROUND OF THE INVENTION

I. Field of the Invention

The present invention generally relates to the field of presses for forming complementary parts including mold parts and metal stampings. In particular, the present invention is concerned with presses for forming complementary parts including mold parts and metal stampings having an articulating frame.

II. Description of the Prior Art

Presses for crushing articles such as scrap automobiles and for vulcanizing operations having separable platens that move from a parallel, opposed position to a parallel, non opposed position are known. Examples of presses of this type are disclosed in U.S. Pat. Nos. 2,558,140; 3,154,009; 3,418,922; 3,641,929; 3,651,754; and 3,942,430. None of the above listed U.S. patents disclose a press for forming complementary parts such as molded parts or sheet metal stampings having an articulating frame with the connecting members of the frame in tension as the parts are formed as disclosed in the present invention.

U.S. Pat. No. 3,650,411 discloses a press for finishing complementary parts having a mechanism for moving a mold half from its working position opposing a complementary mold other half to a position adjacent the press frame where the mold is accessible from overhead. The press frame in this U.S. patent does not articulate as disclosed in the present invention.

III. Prior Art Statement

The aforementioned prior art, in the opinion of the applicant and the applicant's attorney, represents the closest prior art of which the applicant and the applicant's attorney are aware.

SUMMARY OF THE INVENTION

The present invention, which will be described in greater detail hereinafter comprises an articulating frame press for forming complementary parts including mold parts and metal stampings. The press of the present invention includes a first bolster plate and a second bolster plate which in a first position are spaced apart in a parallel opposed manner. A first platen is affixed to the first bolster plate and a movable platen is associated with the second bolster plate. The halves of a mold or die for forming complementary parts are affixed to the fixed and movable platens. The frame of the present invention comprises a first pair of spaced apart frame supports pivotally connected at their ends to the first and second bolster plates. A second pair of spaced apart frame supports having a length less than the first pair of frame supports are pivotally connected at their ends to the first and second bolster plates forming a support which in a first position supports the bolster plates and their associated platens in a parallel opposed manner. The frame supports and the bolsters plates to which they are pivoted form a four bar linkage mechanism which is movable from the first position where the bolster plates and their associated platens are in a parallel, opposed, spaced apart condition to the second position wherein the bolster plates and their associated platens are in a non parallel, non opposed position. A device is provided for rotating the frame from the first position to the second position. In a preferred embodiment, the movable platen includes a cylinder having a cylinder end affixed to the bolster and a rod end affixed to the movable platen. Extension and retraction of the rod provides the movable platen motion. An appropriate fluid power source and valve are provided to actuate the cylinder.

It is therefore a primary object of the present invention to provide a new and improved articulating frame press for forming complementary parts.

It is a further object of the present invention to provide such an articulating frame press incorporating a four bar linkage mechanism to allow the platens of the press to be moved from a first position to a second position.

It is yet another object of the present invention to provide an articulating frame press for forming complementary parts wherein in the first position the platens of the press are in a parallel, opposed, spaced apart position suitable for forming complementary parts, with the frame movable to a second position wherein the platens of the press are in a non parallel, non opposed position for overhead or side access to the mold or die parts.

It is a further object of the present invention to provide an articulating frame press for forming complementary parts that can be manufactured in an inexpensive manner requiring a minimum number of parts.

It is yet a further object of the present invention to provide an articulating frame press for forming complementary parts that can be articulated from a first position to a second position by a rotary actuator.

It is yet another object of the present invention to provide an improved articulating frame press for forming complementary parts that can be moved from a first position to a second position by a rack and pinion actuator.

Further objects, advantages, and applications of the present invention will become apparent to those skilled in the art to which this invention pertains, when the accompanying description of one example of the best mode contemplated for practicing the invention is read in conjunction with the accompanying drawing.

BRIEF DESCRIPTION OF THE DRAWING

In the drawing, like reference numbers refer to like parts throughout the several views, and wherein.

DESCRIPTION OF THE PREFERRED EMBODIMENT

Figure 1:
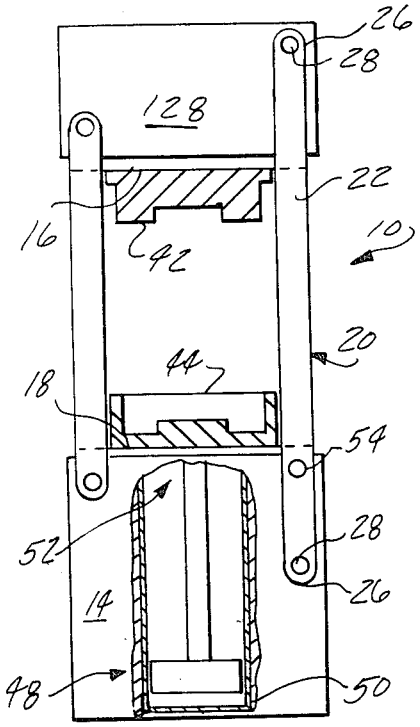
FIG. 1 illustrates a side view of the articulating frame press of the present invention.
Figure 2:
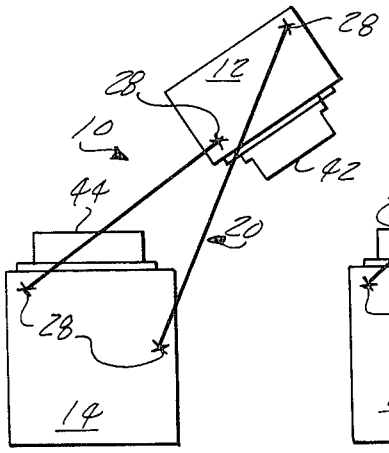
FIG. 2 illustrates the articulating frame press of FIG. 1 articulated to an off center position.

Referring now to the drawing, there is illustrated one example of the present invention in the form of an articulating frame press 10 in FIG. 1. The articulating frame press 10 is adapted to form complementary parts including mold parts and metal stampings and includes a first or pivoting bolster plate 12 and a second bolster plate 14. The bolster plates 12,14 in a first position as illustrated in FIG. 1 are spaced apart in a parallel, opposed, manner. A fixed or pivoting platen 16 is affixed to the first bolster plate 12, and a movable platen 18 is associated with the second bolster plate 14. A frame 20 of the present invention comprises a first pair of spaced apart frame supports 22,24 pivotally connected at their ends 26 to the first bolster plate 12 and the second bolster plate 14 by pivots 28. The pivot 28 comprises a bore 30 formed in the ends 26 to snugly receive a bushing 32. The bushings 32 include a bore 34 to a rotatingly support a journal 36 affixed to the bolster 12,14. The frame 20 further includes a second pair of frame supports 38,40 having a length less than the length of the first pair of frame supports. The second pair of frame supports 38,40 are pivotally connected at their ends to the first and second bolster plates by the pivots 28. The first pair of frame supports 22,24 and the second pair of frame supports 38,40 are arranged in a parallel manner and pivoted to the first and second bolster plates 12,14 to define a four bar linkage mechanism which permits the first or pivoting bolster plate 12 to be movable from a first position wherein it is spaced apart in a parallel manner from the second bolster plate 14 to a second position wherein the pivoting bolster plate 12 is displaced from its first position and assumes a non parallel, non opposed position to the second bolster plate.

Figure 3:
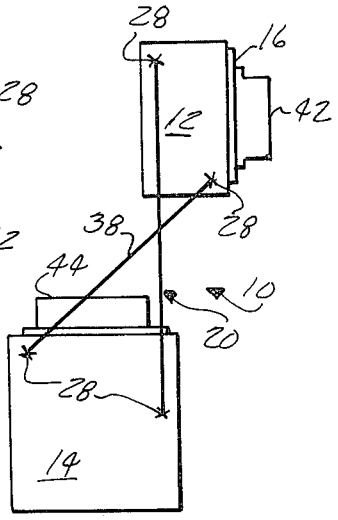
FIG. 3 illustrates the articulating frame press of FIG. 1 articulated to a position where the upper platen is accessible from the side of the press.

As can be best illustrated in FIG. 3, the bolster plate 12 may be moved to a position wherein the bolster plate 12 and its associated fixed platen 16 are positioned in a plane at right angles to the bolster plate 14 rendering a mold or die half 42 accessible from the side of the frame 20. With the press frame 20 articulated to the position as shown in FIG. 3 a second mold or die half 44 is rendered accessible from the top of the bolster 14.

Figure 4:
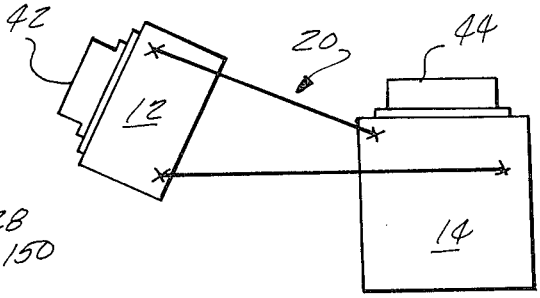
FIG. 4 illustrates the articulating frame press of FIG. 1 articulated to a position where the upper platen is accessible from the top.

As can be best illustrated in FIG. 4 of the drawing the first or pivoting bolster plate 12 may be articulated by the frame 20 to a position which allows access to the mold halves 42,44 from an overhead position without the necessity of removing the mold halves 42,44 from their respective platens. Articulating the press frame 20 to the position shown in FIG. 4 considerably enhances the safety and convenience of the press frame when it is used in mold or die try out or development.

Figure 8:
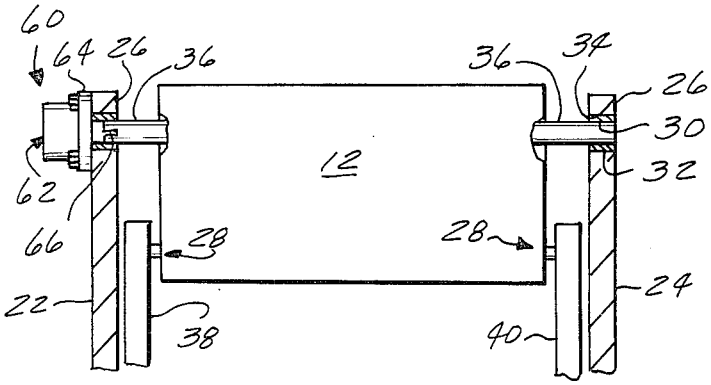
FIG. 8 illustrates a rotary actuator for actuating the press frame.

As can be best shown in FIG. 8 of the drawing the first pair of frame supports 22,24 are spaced out a distance from the bolsters 12,14 to allow the first pair of frame supports 22,24 to cross the second pair of frame supports 38,40 as shown in FIG. 3 without interference and allow the pivoting of the first or second pivoting bolster plate 12 to reach the position shown in FIG. 4 of the drawing.

When the press frame 20 is in its first position as illustrated in FIG. 1 the first or second mold or die halves 42,44 are brought together and separated by a cylinder means 48. A fixed or cylinder end of the cylinder 50 is affixed to the bolster 14, and a rod end 52 of the cylinder 48 supports the platen 18 which in turn provides mounting for the second mold or die half 44. The mold or die halves 42,44 are brought together and separated by standard fluid power circuitry which is well known in the fluid power art. When the mold or die halves 42,44 are pressed together by the cylinder 48 the frame supports 22,24 and 38,40 are placed in tension by the load from the cylinder 48.

Figure 9:
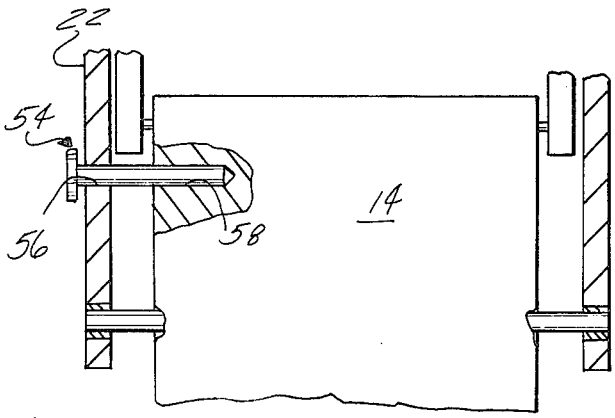
FIG. 9 illustrates a lock pin for securing the press in a first position.

As illustrated in FIG. 9 of the drawing, the articulating press frame 20 is locked in the first position by a first lock pin 54. The first lock pin 54 is configured to slidingly engage a first bore 56 formed in the frame support 22 and a second bore 58 formed in the bolster plate 14 and aligned with the bolster when the frame 20 is in the first position. The first lock pin 54 slidingly and releasably engages the first and second bores 56,58 to releasably lock the frame 20 in the first position.

Figure 7:
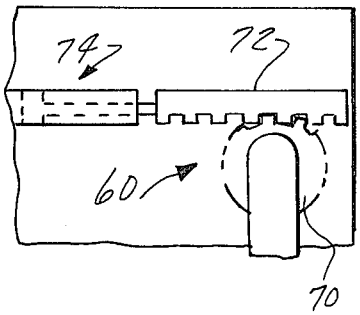
FIG. 7 illustrates a rack and pinion actuator for actuating the press frame.

As shown in FIGS. 7 and 8 of the drawing, a first means 60 is provided for rotating the frame support 22 relative to the bolster plate 12 to pivotally displace the bolster plate 12 from the first position to the second position wherein the bolster plate 12 is in a non parallel, non opposed, attitude relative to the second bolster plate 14. The means 60 as shown in FIG. 8 comprises a conventional rotary actuator 62 having a fixed member 64 mounted to the frame support 22 and a rotary member 66 coupled to the journal 36. The rotary actuator 62 is caused to apply a rotary force to the frame support 22 by the application of fluid pressure to one of its fluid ports (not shown). The direction of rotation of the rotary actuator 62 is determined by which of the actuator's two ports receive fluid pressure. Control of the rotary actuator 62 is established by a standard hydraulic circuit using readily available components incorporating a fluid pressure source, a directional valve, and a counter balance valve to counteract any overrunning tendency due to a shift in the center gravity of the bolsters as the frame 20 is articulated. As shown in FIG. 7 of the drawing the means 60 for rotating one of the frame supports relative to the bolster may alternately comprise a first pinion 70 affixed to the frame support 22, a first rack 72 engaged with the pinion 70, and a cylinder means 74 attached at a cylinder end to the bolster with a rod end engaging the first rack to rotate the first pinion.

Figure 5:
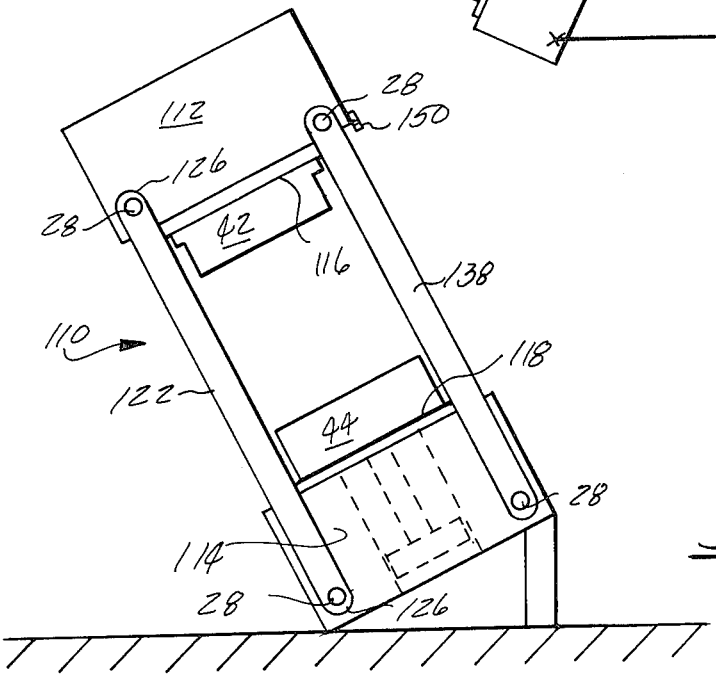
FIG. 5 illustrates an inclined articulating press frame having support members of equal length.
Figure 6:
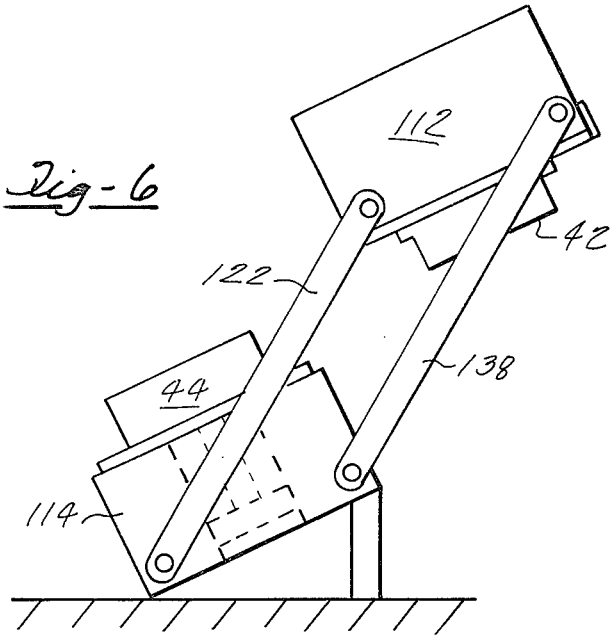
FIG. 6 illustrates a press frame of FIG. 5 articulated to a position where the platens are in a non opposed configuration.

Referring now to FIGS. 5 and 6 of the drawing, there is illustrated at 110 an articulating frame press for forming complementary parts including mold parts and metal stampings wherein the platens of the press remain parallel during articulation. In a preferred embodiment the press 110 in FIGS. 4 and 5 has its platens inclined from the horizontal position to provide convenient access to the platens when the press has been articulated as will be described in more detail subsequently. The articulating frame press 110 comprises a third or movable bolster plate 112 and a fourth bolster plate 114 which in a first position is spaced apart in a parallel opposed manner from the third bolster plate 112. A fixed platen 116 is affixed to the third bolster plate 112, and a movable platen 118 is associated with the fourth bolster plate 114. The frame of the articulating frame press 110 comprises a first pair of support members 122,124 pivotally attached at their ends 126 to the third and fourth bolster plates 112,114. A second pair of support members 138,140 equal in length to and spaced from the first pair of support members are pivotally attached in a spaced apart manner to the third and fourth bolsters 112,114. The third and fourth bolster plates 112,114 together with the firstpair of support members 122,124 and the second pair of support members 138,140 pivotally joined together by pivots 28 define a four bar linkage which in a first position places the bolster plate in a parallel, opposed spaced apart manner, and in a second position, positions the bolster plates 112,114 in a spaced apart non opposed attitude. A rotary actuator or a rack and pinion actuator may be employed to articulate the frame 120 from the first position to the second position.

As can be best illustrated in FIG. 6 of the drawing, the frame 120 may be utilized to transfer parts after they have been formed to a conveyor or other similar parts handling device adjacent the press. This eliminates the need for an intermediate transfer mechanism. As also can be seen in FIG. 6 of the drawing, placing the platens on an incline enables the mold or die halves 42, 44 to be readily accessible when the frame has been articulated to the second position.

Figure 10:
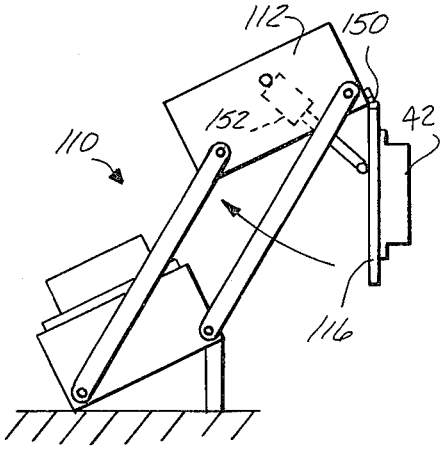
FIG. 10 illustrates the press of FIG. 6 with the upper platen hinged to its bolster and pivoted to a vertical position.

In an alternate embodiment the press 110 has the platen hinged to the bolster 112 as illustrated in FIG. 10 of the drawing. A hinge 150 is employed to hingedly join the platen 116 to the bolster 112. A cylinder means 152 having a cylinder end pivotally attached to the bolster 112 and a rod end pivotally attached to the platen 116 is employed to hinge the platen 116 from a first position abutting the bolster 112 to a second or vertical position for easy access to the mold half 42. It is obvious to the skilled artisan that the press frame 110 illustrated in FIG. 10 can easily employ a non inclined configuration as well as the inclined configuration illustrated.

It is also obvious to the skilled artisan that the movable platen may be associated with either the upper or lower bolster and that the articulating frame described hereinabove may be used with mechanical, pneumatic, or other press actuating systems.

It can thus be seen that the present invention has provided an articulating frame press for forming complementary parts that can be articulated to provide convenient access to the mold or die without removing the die from the platens of the press.

It should be understood by those skilled in the art of articulating frame presses that other forms of the applicant's invention may be had, including platens movable in other than a nominally vertical plane, all coming within the spirit of the invention and the scope of the appended claims.

Having thus described my invention what I claim is:

1. An articulating frame press for forming complementary parts including mold parts and metal stampings; the press including a first bolster plate and a second bolster plate; the bolster plates in a first position spaced apart in a parallel opposed manner; a fixed platen affixed to the first bolster plate and a movable platen associated with the second bolster plate; the frame comprising:

a first pair of spaced apart frame supports pivotally connected at their ends to the first and second bolster plates;

a second pair of spaced apart frame supports having a length less than the first pair of frame supports pivotally connected at their ends to the first and second bolster plates; and means for rotating one of the first pair of frame supports relative to one of the bolster plates to pivotally displace the bolster plates from the first position to a second position wherein the bolster plates are in a non parallel, non opposed position.

2. The articulating frame press as defined in claim 1 wherein the means for rotating one of the frame supports relative to the bolster comprises a rotary actuator.

3. The articulating frame press as defined in claim 1 wherein the means for rotating one of the frame supports relative to the bolster comprises:

a first pinion affixed to the frame support;

a first rack engaged with the pinion; and a cylinder means attached to the bolster for moving the first rack and rotating the first pinion.

4. The articulating frame press as defined in claim 1 wherein the first and second bolster plates when in the first position are inclined from a horizontal plane.

5. The articulating frame press as defined in claim 1 further comprising:

a first bore formed in one of the frame supports;

a second bore formed in the bolster aligned with the first bore when the frame is in the first position; and a first lock pin releasably and slidingly engaging the first and second bores to releasably lock the frame in the first position.

6. An articulating frame press for forming complementary parts including mold parts and metal stampings; the press including a first bolster plate and a second bolster plate; the bolster plates in a first position spaced apart in a parallel opposed manner; a fixed platen affixed the first bolster plate and a movable platen associated with the second bolster plate; the frame comprising:

a first pair of support members pivotally attached at their ends in a spaced apart manner to the first and second bolster plates;

a second pair of support members equal in length to and spaced from the first pair of support members, said second pair of support members pivotally attached at their ends in a spaced apart manner to the first and second bolster plates; and means for rotating at least one of the first pair of support members relative to the bolster plate to displace the bolster plates from a first position wherein the bolster plates are parallel and opposed to a second position wherein the bolster plates are parallel and non opposed.

7. The articulating frame press as defined in claim 6 wherein the means for rotating one of the first pair of support members relative to the bolster plate comprises a rotary actuator.

8. The articulating frame press as defined in claim 6 wherein the first and second bolster plates when in the first position are inclined from a horizontal plane.

9. The articulating frame press as defined in claim 6 further comprising:

a first bore formed in one of the support members;

a second bore aligned with the bolster when the frame is in the first position; and a first lock pin releasably and slidingly engageable with the first and second bores to releasably lock the frame in the first position.

10. The articulating frame press as defined in claim 6 further comprising:

the fixed platen hinged to the first bolster plate; and a cylinder means for rotating the fixed platen from a position abutting the first bolster plate to a non abutting position.

11. The articulating frame press as defined in claim 6 wherein the means for rotating one of the first pair of support members relative to the bolster plate comprises:

a first pinion affixed to one of the support members;

a first rack engaging said first pinion; and a cylinder means attached to the bolster plate for moving said first rack and for rotating said first pinion.

* * * * *